US005862548A

United States Patent [19]

Gerhart

[11] Patent Number: 5,862,548

[45] Date of Patent: Jan. 26, 1999

[54] PLAYYARD SYSTEM AND CANOPY

[75] Inventor: Steven Glenn Gerhart, Reinholds, Pa.

[73] Assignee: Graco Children's Products Inc., Elverson, Pa.

[21] Appl. No.: 738,236

[22] Filed: Oct. 25, 1996

[51] Int. Cl.[6] ..... A47D 7/00; A47D 15/00; A47C 29/00

[52] U.S. Cl. ..... 5/93.1; 5/97; 5/99.1; 135/96; 135/117; 135/124

[58] Field of Search ..... 5/99.1, 94, 414, 5/93.1; 135/96, 115, 117, 33.2, 124, 125, 126; D6/389, 491

[56] References Cited

U.S. PATENT DOCUMENTS

| | | | |
|---|---|---|---|
| D. 285,880 | 9/1986 | Griesenbeck | D6/383 |
| D. 298,768 | 11/1988 | Dwosh et al. | D6/389 |
| D. 304,523 | 11/1989 | Dillner et al. | D6/391 |
| D. 335,046 | 4/1993 | Diaz | D6/389 |
| 2,820,468 | 1/1958 | Park et al. | 5/97 |
| 2,927,331 | 3/1960 | Rulz | 5/97 |
| 2,958,084 | 4/1960 | Kenney | 5/97 |
| 4,766,918 | 8/1988 | Odekirk | 135/96 |
| 4,790,340 | 12/1988 | Mahoney | 135/90 |
| 4,811,437 | 3/1989 | Dillner et al. | 5/99.1 |
| 4,852,598 | 8/1989 | Griesenbeck | 135/102 |
| 4,945,584 | 8/1990 | LaMantia | 5/97 |
| 5,163,191 | 11/1992 | Chan | 5/98.1 |
| 5,339,470 | 8/1994 | Shamie | 5/93.2 |
| 5,560,055 | 10/1996 | Ziegler | 5/99.1 |

FOREIGN PATENT DOCUMENTS

| | | | |
|---|---|---|---|
| 1272565 | 8/1961 | France | 5/97 |

*Primary Examiner*—Alex Grosz
*Attorney, Agent, or Firm*—Richard B. O'Plancik

[57] ABSTRACT

A playyard system includes a playyard structure and a canopy. The playyard structure is partially covered by the canopy which channels heat outward to provide improve shading and ventilation. Sides of the playyard structure have mesh panels with removable covers to further control shading and ventilation. Accordingly, the playyard system has improved thermal characteristics. Furthermore, the canopy allows visibility and easy access to the interior of the playyard structure.

39 Claims, 3 Drawing Sheets

PLAYYARD SYSTEM AND CANOPY

BACKGROUND OF THE INVENTION

1. Field of the Invention

The present invention relates to a playyard system, and more particularly, to a playyard system with improved shading and ventilation characteristics.

2. Discussion of the Related Art

Playyards have been available for many years to provide a convenient and controlled play environment for children. Recently, advances have been made to enhance the transportability of playyards, thereby allowing the playyard to be used in outdoor environments. Examples of transportable playyards are disclosed in U.S. Pat. No. 4,811,437 to Dillner et al. and U.S. patent application Ser. No. 08/556,057 to Nielsen et al., now U.S. Pat. No. 5,586,345 the disclosures of which are hereby incorporated by reference.

Dillner et al. discloses a foldable playyard which is readily collapsible to a storage position without disassembly of any parts. In the storage position, the playyard is easily transportable from one location to another. The playyard includes a frame assembly having a hub member and latch mechanisms to controllably erect and collapse the playyard.

Nielson et al. discloses a mobile portable playyard which includes a playyard structure having wheels and a carrying case having a towing strap. In the folded position, the playyard structure is disposed within the carrying case with the wheels extended through wheel openings of the carrying case for convenient transport of the playyard.

Because playyards are increasingly used in outdoor environments, exposure to sunlight is more common. Accordingly, the sunlight may cause the temperature of the playyard interior to increase. Furthermore, the interior of the playyard may receive ultraviolet (UV) and infrared radiation.

Some users place a cover, such as a towel or blanket, may be placed over the top of playyard in an attempt to block sunlight from the playyard environment. However, this approach is generally not recommended and may affect the temperature of the playyard interior. Because the heat within the playyard rises, and the cover forms a pocket to trap some of the heat, the temperature of the playyard interior increases.

In addition, the sides of the playyard may be formed of a solid material. This will block air from flowing, thereby decreasing ventilation. Consequently, heat cannot escape as easily, thereby causing increased temperature in the interior of the playyard. However, if the sides of the playyard are formed of a mesh material to improve ventilation, sunlight can enter the playyard interior. Accordingly, the playyard environment may receive increased UV and infrared radiation.

SUMMARY OF THE INVENTION

Accordingly, the present invention is directed to a playyard system that substantially obviates one or more of the problems due to limitations and disadvantages of the related art.

An object of the present invention is to provide a playyard having a shaded environment and improved ventilation.

Another object of the present invention is to provide a playyard system with an environment having improved thermal characteristics.

A further object of the present invention is to provide a playyard system which provides protection from UV and infrared radiation.

Yet another object of the present invention is to provide a playyard system with easy access to the interior of the playyard system.

A still further object of the present invention is to provide a playyard system which provides visibility to and from the interior of the playyard system.

Another object of the present invention is to provide a playyard system to allow for ease of use and operation which can be easily manufactured and assembled at a minimal cost.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the playyard system includes a playyard structure including a floor portion and a plurality of side portions, at least one of the side portions being ventilated; and a canopy adapted to connect to the playyard structure, the canopy having a first surface and a second surface, wherein the first surface includes a mesh material extending to an apex of the canopy.

In another aspect, the playyard system includes a playyard structure including a floor and at least three sides, a first side having a mesh portion, a second side and a third side having substantially opaque portions to substantially cover the second and third sides, respectively; and a canopy adapted to connect to the playyard structure including a first surface and a second substantially opaque surface, the second surface being positioned adjacent to the second side to effectively block light incident on the floor surface.

In another aspect, the canopy includes a flexible canopy portion including first and second surface portions; a support member adapted to be connected to the playyard structure to support the flexible canopy portion, wherein the first surface portion has a mesh material extending to an apex of the canopy.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention in the drawings.

DETAILED DESCRIPTION OF THE PREFERRED EMBODIMENTS

Figure 1:
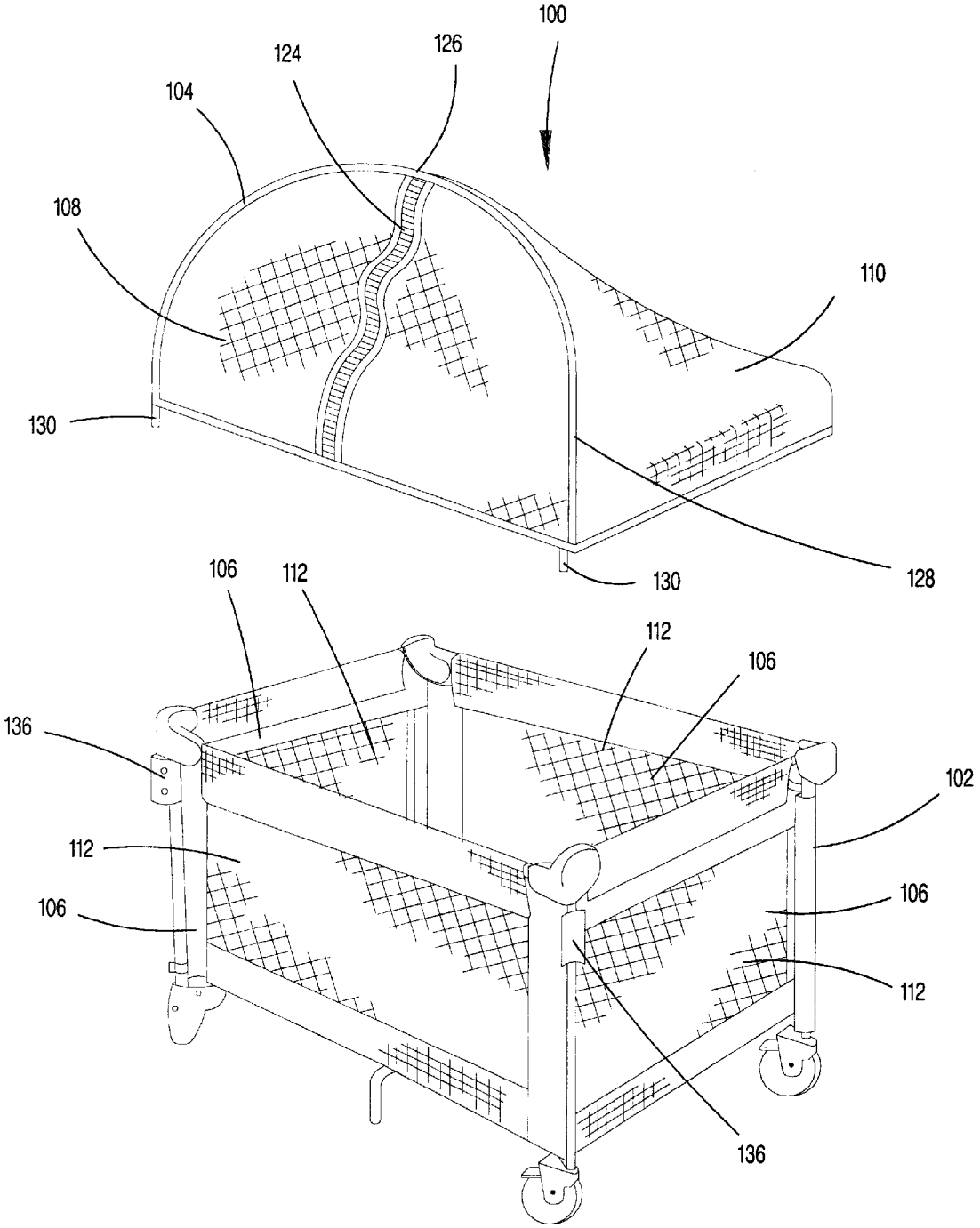
FIG. 1 is an exploded front perspective view of the playyard with a canopy in accordance with a preferred embodiment of the present invention.
Figure 2:
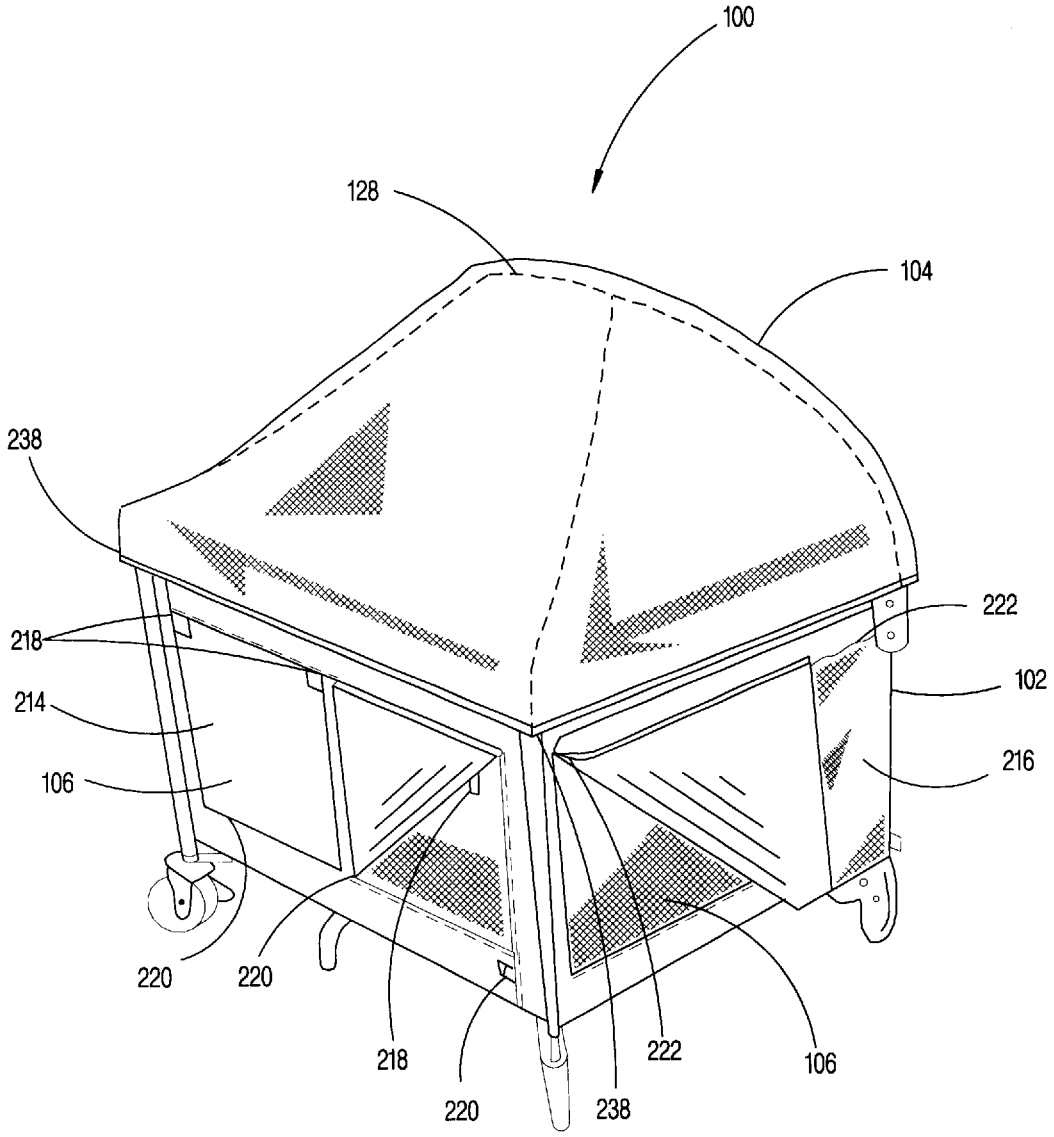
FIG. 2 is an assembled rear perspective view of the playyard with a canopy with the rear flap and the side pouch partially folded to show the mesh panels.

Reference will now be made in detail to the preferred embodiments of the present invention, examples of which are illustrated in the accompanying drawings. Wherever possible, the same reference numbers will be used throughout the drawings to refer to the same or like parts. FIGS. 1 and 2 are respectively an exploded front perspective view and an assembled rear perspective view of the preferred playyard with a canopy.

In accordance with the invention, the playyard system 100 invention comprises a playyard structure 102 and a canopy 104. As embodied herein, the playyard structure 102 includes a floor portion and a plurality of sides 106. The canopy 104 includes a first surface 108 and a second substantially opaque surface 110.

The invention will now be further clarified by the following example, which are intended to be purely exemplary of the invention.

Referring to 1 and 2, the preferred playyard structure 102 has the foldability and portability features referred to above. In addition, the playyard structure 102 includes sides 106 having mesh panels 112. The mesh panels 112 allow ventilation and visibility to the playyard environment. In a preferred embodiment, opaque material portions 214 and 216 are used to cover rear and side mesh panels 106. The opaque material preferably has a flexible reflective backing, such as a metallized backing, as disclosed in the concurrently filed U.S. Patent Application entitled "Improved Material for Use in a Canopy" by Messner U.S. patent application Ser. No. 08/738,169), the disclosure of which is hereby incorporated by reference herein. The opaque material portions 214 and 216 are also preferably displaceable. The displaceability may be accomplished by removing or rolling up the opaque material portions 214 and 216.

As shown in FIG. 2, the rear opaque material portion 214 comprises a flap that rolls up. When rolled, the flap is fastened in an up position by fastening means 218 which may include straps with snaps, hook-and-rug (VELCRO) straps, ties, or the like. When in the down position, the bottom of opaque material portion 214 is secured by securing means 220 such as snaps, hook-and-rug (VELCRO) patches, ties, or the like. The side opaque material portion 216 is fastened by means 222 such as snaps, hook-and-rug (VELCRO) patches, ties, or the like. The side opaque material portion 216 preferably includes a storage pocket to provide additional storage. The storage pocket should be disposed on the side 106 of the playyard structure 102 with a smaller dimension for greater stability of the playyard system 100.

Generally, the rear side 106 would be oriented toward the sun during use. Accordingly, it is desirable to have the rear opaque material portion 214 in the down position when the sun is incident on the playyard system 100. However, when the playyard system 100 is used in a shaded environment, sun is not incident on the playyard system 100. Therefore, it may be desirable to have the rear opaque material portion 214 in the up position to provide additional ventilation. Similarly, the side opaque material portion 216 may be used to block sunlight from the side or removed to provide additional ventilation. Of course, the side opaque material portion 216 may be provided on the right side or the left side.

An example of the use of the playyard system 100 in accordance with the present invention will now be described. The rear of the playyard system 100 is positioned to the South toward the sun. Accordingly, the rear opaque portion 214 would block the sunlight when in the down position. Also, as the sun moves from East to West, the side opaque material portion 216 is moved from the left side of the playyard system 100 to the right side to block the sunlight as the sun moves across the sky. The uncovered side mesh panel 112 provides additional ventilation. Accordingly, only one side opaque material 216 is needed if fastening means 222 are provided on both the right and the left sides.

As stated above, the canopy 104 includes a first surface 108 and a second substantially opaque surface 110. In the preferred canopy 104, the first surface is substantially semicircular and formed of a mesh material. The mesh material provides both visibility and ventilation. The first surface 108 further includes a zippered opening 124 to provide access to the interior of the playyard system 100. As mentioned, the second surface 110 is substantially opaque, thereby blocking an incident light. Therefore, shade is provided for the interior of the playyard system 100. The second surface 110 in the preferred embodiment has a flexible reflective backing, such as a metallized backing, as disclosed above. Moreover, the second surface 110 is substantially continuously upward sloping to a central point 126 of an interface between the first surface and the second surface. In the preferred canopy 104, the central point 126 is the apex of the canopy 104, and the mesh material of the first surface 108 extends to the apex.

The canopy 104 is supported by a support member 130. In the preferred embodiment, a singular support member 130 is inserted within a sleeve 128 located along the interface of the first surface 108 and the second surface 110. However, the canopy 104 can be connected to the support member 130 using clips or the like.

Figure 3:
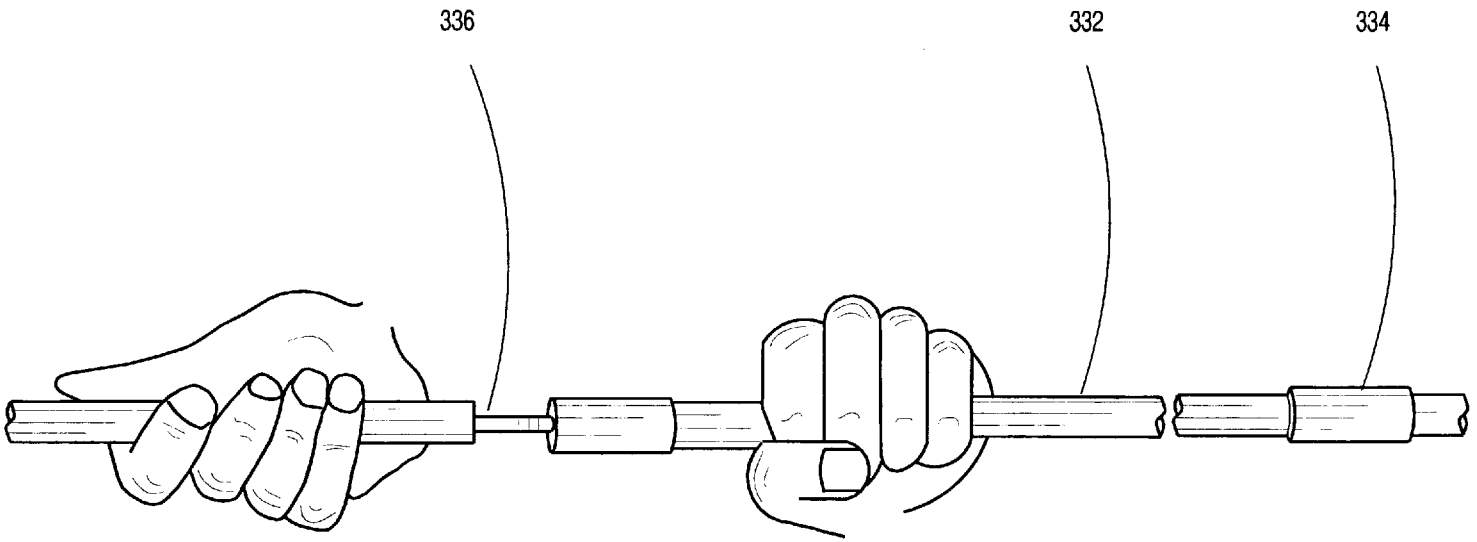
FIG. 3 is a side view of a support member in a preferred embodiment during assembly.

FIG. 3 shows a preferred support member 130. The preferred support member 130 includes sections 332, flanges 334, and an elastic cord 336. The support member 130 is substantially straight and flexible when assembled but not inserted into the sleeve 128. As shown, the support member 130 is assembled by inserting an end of a section 332 into an end of an adjacent section 332 having a flange 334. The sections are maintained together by a combination of a friction fit and the elastic cord 336. Preferably, the lengths of each section 332 is smaller than a dimension of the playyard structure 102 when folded so that the support member can be conveniently stored within the carrying case of the playyard system 100.

The zippered opening 124 is unzipped when inserting the support member 130 into the sleeve 128. This allows the sleeve 128 to be substantially straight when inserting the support member 130. The length of the support member 130 is such that both ends extend beyond the sleeve 128 as shown in FIG. 1. The playyard structure 102 further includes connection members 136. In the preferred embodiment, two connection members 136 are located on front vertical edges of the playyard structure. The connection members 136 are adapted to receive the ends of the support member 130 which are held by a friction fit.

The second surface 110 is fit over the playyard structure 102 as shown in FIG. 2. The canopy 104 preferably includes elastic portions 238 at the lower end of the fabric at rear corners for retaining the canopy 104 on the playyard structure 102.

The playyard system as shown and described provides improved shade and ventilation. Moreover, heat within the interior will rise. The rising heat will be channeled to the apex of the canopy because the second surface of the canopy is substantially continuously upward sloping to the apex. The heat then escapes through the first surface of the canopy because the mesh material of the first surface extends to the apex. This prevents the trapping of heat within the canopy in accordance with the present invention. Furthermore, because at least one side of the preferred playyard structure includes an open mesh panel, a chimney effect may be obtained to efficiently remove heat. Accordingly, the playyard system in accordance with the present invention provides an environment with reduced temperature as compared with conventional solutions. Also, the playyard environment receives less UV and infrared radiation.

It will be apparent to those skilled in the art that various modifications and variations can be made in the playyard system of the present invention without departing from the spirit or scope of the invention. Thus, it is intended that the present invention cover the modifications and variations of this invention provided they come within the scope of the appended claims and their equivalents.

What is claimed is:

1. A playyard system, comprising:

a playyard structure including a floor portion and a plurality of side portions, at least one of the side portion being ventilated; and a canopy adapted to connect to the playyard structure, the canopy having a first surface and a second surface, wherein the first surface includes a mesh material extending to an apex of the canopy, the canopy further including elastic portions adapted to be fitted over the playyard structure.

2. The playyard system according to claim 1, wherein the first surface includes a zippered opening.

3. The playyard system according to claim 1, wherein the first surface is substantially semicircular and wherein the second surface is substantially continuously upward sloping to a central point of an interface between the first surface and the second surface.

4. The playyard system according to claim 1, wherein the second surface is substantially opaque.

5. The playyard system according to claim 1, wherein the canopy further includes a support member to support the canopy.

6. The playyard system according to claim 5, wherein the support member includes a plurality of sections interconnected by an elastic cord and flanges.

7. The playyard system according to claim 5, wherein the canopy further includes a sleeve adapted to receive the support member.

8. The playyard system according to claim 7, wherein the sleeve is disposed at an interface between the first and second surfaces.

9. The playyard system according to claim 7, wherein the playyard structure further includes a connection member adapted to receive the support member.

10. The playyard system according to claim 9, wherein the support member is friction fit in the support member.

11. A playyard system, comprising:

a playyard structure including a floor and at least three sides, a first side having a mesh portion, a second side and a third side having substantially opaque portions to substantially cover the second and third sides, respectively; and a canopy adapted to connect to the playyard structure including a first surface and a second substantially opaque surface, the second surface being positioned adjacent to the second side to effectively block light incident on the floor surface.

12. The playyard system according to claim 11, wherein the first surface includes a zippered opening.

13. The playyard system according to claim 11, wherein the first surface is substantially semicircular and wherein the second surface is substantially continuously upward sloping to a central point of an interface between the first surface and the second surface.

14. The playyard system according to claim 11, wherein the canopy further includes a support member to support the canopy.

15. The playyard system according to claim 14, wherein the support member includes a plurality of sections interconnected by an elastic cord and flanges.

16. The playyard system according to claim 14, wherein the canopy further includes a sleeve adapted to receive the support member.

17. The playyard system according to claim 16, wherein the sleeve is disposed at an interface between the first and second surfaces.

18. The playyard system according to claim 14, wherein the playyard structure further includes connection members adapted to receive the support member.

19. The playyard system according to claim 18, wherein, the support member is friction fit in the connection member.

20. The playyard system according to claim 11, wherein the canopy further includes elastic portions adapted to be fitted over the playyard structure.

21. The playyard system according to claim 11, wherein the opaque portion of the second side is adapted to roll into an up position to expose a mesh portion of the second side.

22. The playyard system according to claim 21, wherein the second side includes means for fastening the opaque portion of the second side in the up position.

23. The playyard system according to claim 11, wherein the opaque portion of the third side is removable to expose a mesh portion of the third side.

24. The playyard system according to claim 23, wherein the third side includes means for fastening the opaque portion of the third side to the third side.

25. The playyard system according to claim 11, further comprising a fourth side having a mesh portion.

26. A canopy adapted to connect to a playyard structure, comprising:

a flexible canopy portion including first and second surface portions; and a support member adapted to be connected to the playyard structure to support the flexible canopy portion, wherein the first surface portion has a mesh material extending to an apex of the canopy, the canopy further including elastic portions adapted to be fitted over the playyard structure.

27. The canopy according to claim 26, wherein the first surface includes a zippered opening.

28. The canopy according to claim 26, wherein the first surface is substantially semicircular and wherein the second surface is substantially continuously upward sloping to a central point of an interface between the first surface and the second surface.

29. The canopy according to claim 26, wherein the support member includes a plurality of sections interconnected by an elastic cord and flanges.

30. The canopy according to claim 26, wherein the canopy portion further includes a sleeve adapted to receive the support member.

31. The canopy according to claim 30, wherein the sleeve is disposed at an interface between the first and second surfaces.

32. A canopy adapted to connect to a playyard structure and to substantially completely cover the open top portion of said playyard structure, comprising:

a flexible canopy portion consisting of first and second nonhorizontal surface portions defining an apex portion;

a support member consisting of a singular support member disposed between said first and second surface portions.

33. The canopy according to claim 32, wherein the first surface includes a mesh material.

34. The canopy according to claim 32, wherein the first surface includes a zippered opening.

35. The canopy according to claim 32, wherein the first surface is substantially semicircular and wherein the second surface is substantially continuously upward sloping to a central point of an interface between the first surface and the second surface.

36. The canopy according to claim 32, wherein the singular support member includes a plurality of sections interconnected by an elastic cord and flanges.

37. The canopy according to claim 32, wherein the canopy portion further includes a sleeve adapted to receive the singular support member.

38. The canopy according to claim 37, wherein the sleeve is disposed at an interface between the first and second surfaces.

39. The canopy according to claim 32, wherein the canopy portion further includes elastic portions adapted to be fitted over the playyard structure.

* * * * *